US010722080B2

(12) United States Patent
Ciavarella et al.

(10) Patent No.: US 10,722,080 B2
(45) Date of Patent: Jul. 28, 2020

(54) FOAM-AT-A-DISTANCE SYSTEMS AND ANTI-DRIP MECHANISMS FOR SUCH SYSTEMS

(71) Applicant: GOJO Industries, Inc., Akron, OH (US)

(72) Inventors: Nick E. Ciavarella, Seven Hills, OH (US); Dennis K. Jenkins, Akron, OH (US)

(73) Assignee: GOJO Industries, Inc, Akron, OH (US)

( * ) Notice: Subject to any disclaimer, the term of this patent is extended or adjusted under 35 U.S.C. 154(b) by 0 days.

(21) Appl. No.: 16/392,878

(22) Filed: Apr. 24, 2019

(65) Prior Publication Data

US 2019/0328181 A1 Oct. 31, 2019

Related U.S. Application Data

(60) Provisional application No. 62/662,258, filed on Apr. 25, 2018.

(51) Int. Cl.
*A47K 5/14* (2006.01)
*A47K 5/06* (2006.01)
(Continued)

(52) U.S. Cl.
CPC ..... *A47K 5/14* (2013.01); *A47K 5/06* (2013.01); *B05B 7/0018* (2013.01); *B05B 11/3087* (2013.01); *B05B 11/3097* (2013.01)

(58) Field of Classification Search
CPC ..... A47K 5/14; A47K 5/06
(Continued)

(56) References Cited

U.S. PATENT DOCUMENTS 7,850,049 B2 * 12/2010 Ciavarella ..... A47K 5/14 222/190
8,544,698 B2 * 10/2013 Ciavarella ..... A47K 5/14 222/145.5

(Continued)

FOREIGN PATENT DOCUMENTS

WO 2012020253 A2 2/2012

OTHER PUBLICATIONS

International Search Report and Written Opinion from PCT/US2019/06270 dated Sep. 13, 2019 (15 pages).

*Primary Examiner* — Vishal Pancholi
(74) *Attorney, Agent, or Firm* — Calfee, Halter & Griswold LLP

(57) ABSTRACT

Exemplary foam-at-a-distance systems include a spout, a container, and a foam generator having a suck-back mechanism located within the spout. The system includes a liquid pump chamber, an air pump chamber, a liquid conduit and an air conduit. The foam generator has a differential bore housing. The differential bore housing has a first portion with a first inside bore and a second portion with a second inside bore, wherein the first inside bore has a smaller diameter than the second inside bore. A piston having a seal extending from the piston that is in contact with the second inside bore is also included. A mixing chamber is located in the large bore. Movement of the seal in an upstream direction provides negative pressure in the second mixing chamber and draws in fluid from the outlet.

20 Claims, 3 Drawing Sheets

(51) Int. Cl.
*B05B 7/00* (2006.01)
*B05B 11/00* (2006.01)

(58) Field of Classification Search
USPC ..... 222/52, 63, 135, 145.5, 173, 180, 183, 222/190, 325, 333
See application file for complete search history.

(56) References Cited

U.S. PATENT DOCUMENTS 8,893,928 B2 * 11/2014 Proper ..... B67D 7/76 222/173
8,991,657 B2 * 3/2015 Ciavarella ..... A47K 5/14 222/145.5
9,579,613 B2 * 2/2017 Fawcett ..... B01F 3/04992
9,730,558 B2 * 8/2017 McNulty ..... A47K 5/14
2011/0056990 A1 3/2011 Proper et al.
2012/0248149 A1 10/2012 Pelfry
2013/0140331 A1 * 6/2013 Renfrew ..... A47K 5/14 222/190
2013/0299517 A1 11/2013 Ciavarella et al.
2013/0341358 A1 12/2013 Ciavarella et al.
2014/0054322 A1 2/2014 McNulty et al.
2014/0054323 A1 2/2014 McNulty et al.
2014/0061246 A1 3/2014 McNulty et al.
2014/0124540 A1 5/2014 Ciavarella et al.
2014/0205473 A1 7/2014 Ciavarella et al.
2014/0261799 A1 9/2014 Ciavarella et al.
2014/0263462 A1 9/2014 Quinlan et al.
2015/0014360 A1 * 1/2015 Chen ..... A47K 5/14 222/190
2015/0090737 A1 4/2015 Ciavarella et al.
2015/0102067 A1 * 4/2015 Ciavarella ..... B05B 7/0037 222/190
2015/0251892 A1 * 9/2015 Ciavarella ..... A47K 5/1204 141/326
2015/0335208 A1 11/2015 Ciavarella et al.

* cited by examiner

FOAM-AT-A-DISTANCE SYSTEMS AND ANTI-DRIP MECHANISMS FOR SUCH SYSTEMS

RELATED APPLICATIONS

This application claims the benefits of and priority to U.S. Provisional Patent Application Ser. No. 62/662,258, titled FOAM-AT-A-DISTANCE SYSTEMS AND ANTI-DRIP MECHANISMS FOR SUCH SYSTEMS, which was filed on Apr. 25, 2018 and which is incorporated herein by reference in its entirety.

TECHNICAL FIELD

The present invention relates generally to foam-at-a-distance dispenser systems and more particularly to anti-drip mechanisms for foam-at-a-distance systems.

BACKGROUND OF THE INVENTION

Dispenser systems, such as liquid soap and sanitizer dispensers, provide a user with an amount of fluid upon actuation of the dispenser. Counter mount systems often have an air pump and a liquid pump located (which may be separate pumps or one pump that provides both functions) under the counter and an outlet nozzle located above the counter. Many of these systems create foam below the counter and push the foam up though a dispense tube to the outlet nozzle located at the end of a spout. Pushing foam up the dispense tube requires more energy than creating the foam near the outlet. This is problematic because most counter mount dispensing systems rely on batteries for power. Accordingly, the higher energy the system uses the quicker the batteries will drain. In addition, residual foam may break down in the dispense tube with within about 15 minutes and thus, the next dose of fluid may contain air, liquid and/or a poor-quality foam. One solution is to push liquid and air up separate tubes and mix the liquid and air near the end of the spout which is known as foam-at-a distance. U.S. Pat. No. 7,819,289, which is incorporated herein in its entirety, discloses separate air and liquid pumps feeding separate tubes to a foam-at-a-distance nozzle. U.S. Pat. Publication 2008/02372266, which is also incorporated herein in its entirety, discloses a refill unit having a combined air and liquid pump that uses separate liquid and air tubes to feed liquid and air to a foam-at-a-distance nozzle. Because of the shape of the spout, the end of the tubes typically slope downward. As a result, often times these systems drip as residual foam breaks down into liquid near the outlet nozzle.

SUMMARY

Exemplary embodiments of foam-at-a-distance systems and suck-back mechanisms for such systems are disclosed herein. An exemplary foam-at-a-distance system includes a dispenser housing configured for mounting below a counter, a spout configured for mounting above a counter, a container configured for mounting below a counter and a foam generator having a suck-back mechanism located within the spout. In addition, the exemplary system includes a liquid pump portion, an air pump portion, a liquid conduit placing the liquid pump portion in fluid communications with a liquid inlet in the foam generator and an air conduit placing the air pump in fluid communications with an air inlet in the foam generator. The foam generator has a housing. The housing has a first portion with a first inside bore and a second portion with a second inside bore. The first inside bore has a smaller diameter than the second inside bore. Also included is piston having a first seal in contact with the first inside bore and a second seal that is in contact with the second inside bore. The piston includes a hollow stem. A first mixing chamber is located downstream of the first seal and upstream of the second seal. A liquid inlet is located upstream of the first seal. An air inlet is located downstream of the first seal and upstream of the second seal. An aperture is located in the hollow stem placing the first mixing chamber in fluid communication with the interior of the hollow stem. A second mixing chamber located at least partially within the large bore. One or more mix media is located downstream of the second mixing chamber and upstream of a foam outlet. Movement of the second seal in an upstream direction provides negative pressure in the second mixing chamber and draws in fluid from the outlet.

Another exemplary foam-at-a-distance system includes a spout configured for mounting above a counter, a container configured for mounting below a counter, and a foam generator having a suck-back mechanism located within the spout. A liquid pump portion and an air pump portion is included. A liquid conduit places the liquid pump portion in fluid communications with a liquid inlet in the foam generator. An air conduit places the air pump portion in fluid communications with an air inlet in the foam generator. The foam generator has a housing that has a first portion with a first inside bore and a second portion with a second inside bore. The first inside bore has a smaller diameter than the second inside bore. The foam generator further includes a piston having a first seal in contact with the first inside bore and a second seal in contact with the second inside bore, a first mixing chamber located downstream of the first seal and upstream of the second seal, a liquid inlet located upstream of the first seal, an air inlet located downstream of the first seal and upstream of the second seal and a second mixing chamber located at least partially within the large bore. Movement of the second seal in an upstream direction provides negative pressure in the second mixing chamber and draws in fluid from the outlet.

Another exemplar foam-at-a-distance system includes a spout configured for mounting above a counter, a container configured for mounting below a counter, and a foam generator having a suck-back mechanism located within the spout. In addition, the system includes a liquid pump chamber, an air pump chamber, a liquid conduit placing the liquid pump chamber in fluid communications with a liquid inlet in the foam generator and an air conduit placing the air pump chamber in fluid communications with an air inlet in the foam generator. The foam generator has a differential bore housing. The differential bore housing has a first portion with a first inside bore and a second portion with a second inside bore, wherein the first inside bore has a smaller diameter than the second inside bore. A piston having a seal extending from the piston that is in contact with the second inside bore is also included. A mixing chamber is located at least partially within the large bore. Movement of the seal in an upstream direction provides negative pressure in the second mixing chamber and draws in fluid from the outlet.

Another exemplary foam-at-a-distance system includes a spout configured for mounting above a counter, a container configured for mounting below a counter, a foam generator located within the spout, a liquid pump chamber, an air pump chamber, a liquid conduit placing the liquid pump chamber in fluid communications with a liquid inlet in the foam generator and an air conduit placing the air pump chamber in fluid communications with an air inlet in the foam generator. The foam generator further includes a piston, the piston moves between a first position and a second position. Liquid flowing in through the liquid inlet moves the piston in a first direction and a biasing member moves the piston in a second direction that is substantially opposite the first direction. The piston includes a first piston seal that is configured to allow liquid to flow past the first piston seal. The liquid inlet is located upstream of the first piston seal and the air inlet is located downstream of the first piston seal. A second piston seal is located downstream of the air inlet. A mixing chamber is also included. Movement of the second piston seal in a downstream direction decreases the volume of the mixing chamber and movement of the second piston seal in an upstream direction increases the volume of the mixing chamber, which draws in fluid from the outlet.

In this way, a simple and economical foam-at-a-distance systems and nozzles with anti-drip suck-back mechanisms are provided.

BRIEF DESCRIPTION OF THE DRAWINGS

These and other features and advantages of the present invention will become better understood with regard to the following description and accompanying drawings in which.

DETAILED DESCRIPTION

Figure 1:
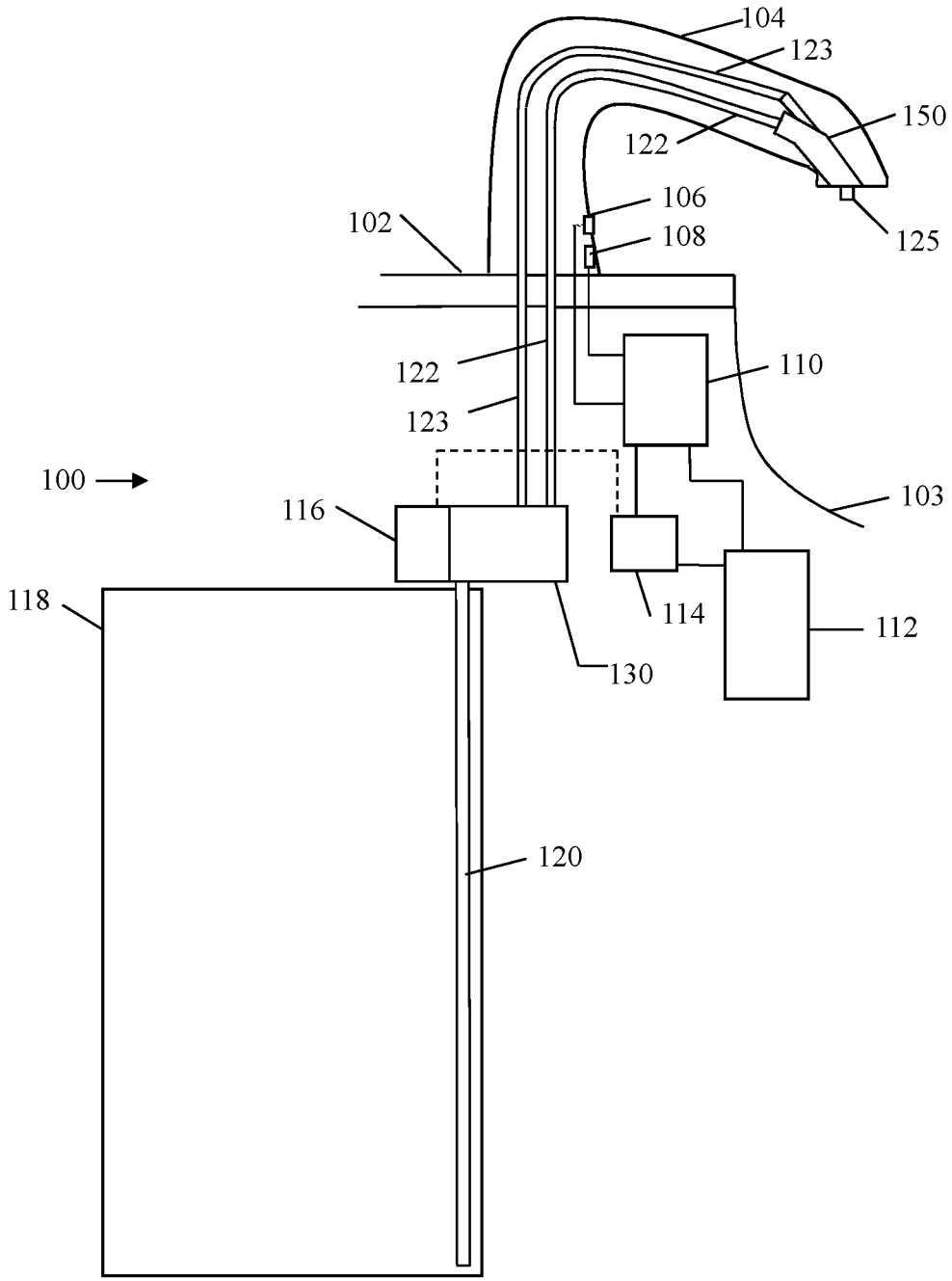
FIG. 1 is a schematic view of an exemplary embodiment of a foam-at-a-distance dispenser system.

FIG. 1 is a schematic view of an exemplary embodiment of a foam-at-a-distance dispenser system 100 with a suck-back mechanism. Foam-at-a-distance dispenser system 100 includes a spout 104, which is mounted to a countertop 102. Spout 104 includes an object sensor 106, such as, for example, an infrared sensor, a motion sensor, a capacitance sensor or the like. Object sensor 106 is used to detect the presence of an object, preferably a user's hand. Sensor 106 is in circuit communication with controller 110. Controller 110 may include a processor, a microprocessor or the like. Controller 110 also includes any necessary memory or circuitry required to perform the functions described herein. In addition, in some embodiments, spout 104 includes feedback indicator 108. Feedback indicator 108 may provide a visual and/or an audible feedback to a user. Exemplary visual feedback indicators maybe, for example, one or more light emitting diodes (LEDs). Feedback indicator 108 may be used to inform a user of the status of the dispenser, such as, for example, a green light indicating that the dispenser is functioning properly, or a red light may indicate that there is a problem with the dispenser, such as, for example, "out of soap" or "out of order". Controller 110 is in circuit communication with sensor 106, indicator 108 and pump actuator 114. Pump actuator 114 may be, for example, a motor, a motor that rotates and one or more gears, or gear trains, or the like, that may be used to actuate foam-at-a-distance dispenser pump 116.

"Circuit communication" indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication.

A power source 112 provides power to the controller 110, pump actuator 114 and any other components that require power. Power supply 112 may be one or more batteries, a hard-wired power source and draw power, from for example, a 120 VAC line, a solar panel, combinations thereof or the like. Power supply 112 may include any necessary transformers, rectifiers, or power conditioning components needed to obtain suitable power for the components described herein. In this exemplary embodiment, pump actuator 114 actuates motor 116 which drives pump 130 that pumps liquid up conduit 122 and air up conduit 123 two foam-at-a-distance nozzle 150. The pumps disclosed herein may be separate air and liquid pumps or may be a single pump that separately pumps both liquid and air.

Pump(s) 130 is connected to inlet dip tube 120, which is located in container 118, and liquid dispense tube 122 and air dispense tube 123 (which in some embodiments are coaxial) that extend up through spout 104 to foam generator 124 (that includes an inventive suck-back mechanism), where the liquid and air are mixed together in foam-at-of-distance nozzle 150 and dispensed through outlet 125. In some embodiments, one or more of the container 118, pump(s) 130, dip tube 120, outlet tubes 122, 123 and foam-at-a-distance nozzle/generator 150 form a refill and may be replaced when container 118 runs out of fluid or stops working. Container 118 contains a fluid, such as, for example, a foamable soap, sanitizer, or lotion. In some embodiments, container 118 is refillable. In some embodiments, container 118 is refillable from above the counter 102.

Controller 110 includes logic or circuitry for operating pump actuator 114 that operates pump(s) 130 and the other electronic components identified above as required. "Logic" is synonymous with "circuit" or "circuitry" and includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

Figure 2:
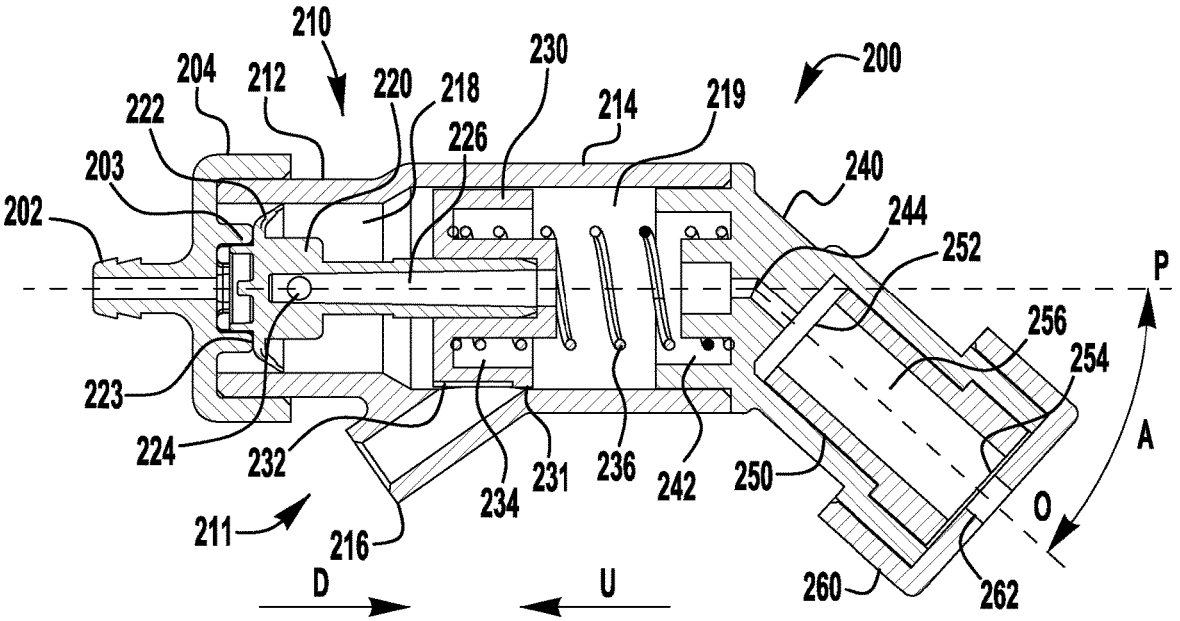
FIG. 2 is a cross-section of an exemplary foam-at-a-distance generator having a suck-back mechanism with the piston in the rest state.

FIG. 2 is a cross-section of an exemplary embodiment of a foam-at-a-distance generator 200 having a suck-back mechanism 210. Suck-back mechanism 210 includes a differential bore housing 211 that has a first portion 212 having a small bore and a second portion 214 having a large bore. Piston 220 includes a wiper seal 222 that contacts the interior of the small bore of first portion 212. Attached to the lower end of piston 220 is suck-back sleeve 230. Suck-back sleeve 230 includes a sealing member 231 the contacts the interior bore of second portion 214 of housing 211. In some embodiments, suck-back sleeve 230 includes serrations 232 that allow air from one or more air pumps (not shown) to flow through air inlet 216 up into mixing chamber 218. In some embodiments, suck-back sleeve 230 is an integral part of piston 220. In some embodiments, piston 220 includes first wiper seal 222 and sealing member 231, which may also be a wiper seal.

Piston 220 includes one or more apertures 224 which lead(s) to the hollow interior 226 of piston 220 and suck-back sleeve 230. Housing 211 includes an air inlet 216 that enters into an upper area of second portion 214 of housing 211. The air inlet 216 enters above sealing member 231 so that air flowing through air inlet 216 flows up into first mixing chamber 218. In addition, in some embodiments, suck-back sleeve 230 includes an annular recess 234 for receiving a first end of biasing member 219. Biasing member 219 may be any member that urges piston 220 and suck-back sleeve 230 in the upstream direction "U", such as, for example, a spring, an elastomeric member, a bellows, or the like.

Connected to second portion 214 of housing 211 of suck back mechanism 210 is foaming housing 240. Foaming housing 240 includes an annular recess 242 for receiving a second end of biasing member 219. Foaming housing 240 also includes a pathway 244. A portion of pathway 244 is sized to receive foaming cartridge 250. Foaming cartridge 250 includes a first screen 252, a foaming area 256, a second screen 254. Located at the distal end of pathway 244 is an outlet 262 located in cap 260. In some embodiments, one or more of the screens may be replaced by one or more different porous member, such as, for example, one or more sponges. In some embodiments, foaming cartridge 250 may include one or more sponges. In some embodiments, the foam cartridge, or portions thereof, may be replaced by one or more baffles, one or more porous members, such as screens, sponges, foam, or the like.

Connected to first portion 212 of housing 211 of suck-back mechanism 210 is cap 204. Cap 204 includes a liquid inlet 202 for receiving liquid from one or more liquid pumps (not shown). Cap 204 includes an annular seat 203. Piston 220 includes a sealing surface 223 that seals against annular seat 203 when the piston 220 is in its rest position or its fully upstream position as shown in FIG. 2. In this position, piston 220 functions as a liquid inlet valve closing off liquid inlet 202. In some embodiments, the pressure exerted by biasing member 236 is sufficient to prevent any head pressure, caused by, for example, the container being inverted during shipping, to cause fluid to leak out of the container.

A piston axis "P" extends through the piston along the axis of piston movement. An outlet axis extends through the outlet 262 along the fluid flow. In some embodiments, the angle "A" between the piston axis P and the outlet axis O is between about 0 and 90°. In some embodiments, the angle "A" between the piston axis P and the outlet axis O is between about 0 and 30°. In some embodiments, the angle "A" between the piston axis P and the outlet axis O is between about 15 and 75°. In some embodiments, the angle "A" between the piston axis P and the outlet axis O is between about 20 and 60°.

Figure 2A:
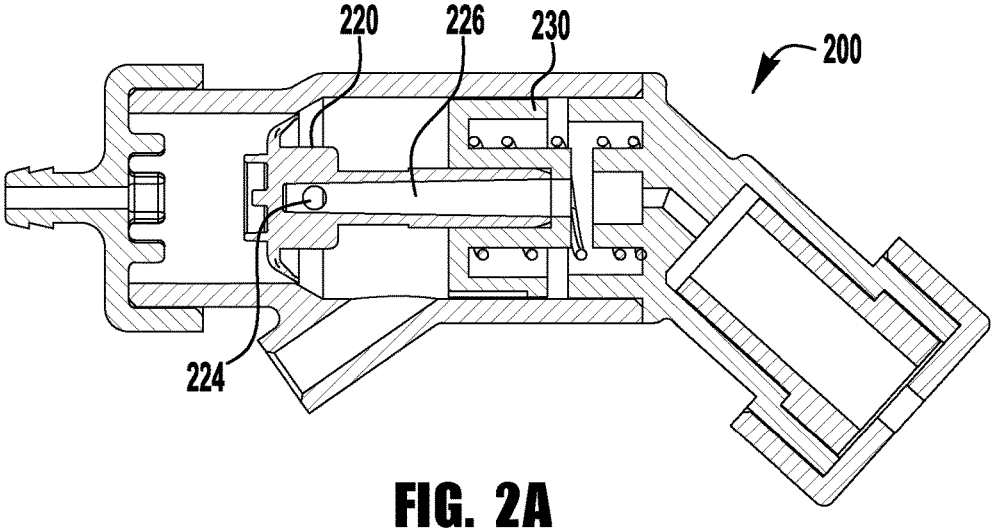
FIG. 2A is a cross-section of the exemplary foam-at-a-distance generator of FIG. 2 having a suck-back mechanism with the piston in the dispensing state.

FIG. 2A is a cross-section of the exemplary foam-at-a-distance generator of FIG. 2 having a suck-back mechanism 210 with the piston 220 and suck-back sleeve 230 in the dispensing state, i.e. the downstream position D.

During operation one or more pumps (not shown) pump liquid into liquid inlet 202 and air into the air inlet 216. In some embodiments, air enters air inlet 216 at the same time as liquid enters liquid inlet 202. In some embodiments, air enters air inlet 216 prior to liquid entering liquid inlet 202. In some embodiments, liquid enters liquid inlet 202 prior to air entering air inlet 216. In some embodiments, the flow of liquid into liquid inlet 202 and air into air inlet 216 stops substantially simultaneously. In some embodiments, the flow of liquid into liquid inlet 202 stops prior to air stopping its flow into inlet 216. In some embodiments, the flow of liquid entering liquid inlet 202 continues after air stops flowing into air inlet 216.

Liquid flowing into liquid inlet 202 moves piston 220 and suck-back sleeve 230 in a downstream direction D, as shown in FIG. 2A. The liquid flows past wiper seal 222 into first mixing chamber 218. Air flows into air inlet 216, through serrations 232 in suck-back sleeve 230, and into first mixing chamber 218. The air and liquid meet in first mixing chamber 218 forming a liquid/air mixture that flows through aperture 224, through passage 226 and into second mixing chamber 219. The air/liquid mixture flow through passage 244, through screen 252, into foaming area 256, through screen 254 and out of outlet 262.

When the flow of liquid through liquid inlet 202 stops, biasing member 236 urges piston 220 and suck-back sleeve 230 in the upstream direction U to its rest state shown in FIG. 2. Movement of suck-back sleeve 230 in the upstream direction expands second mixing chamber 219. Expansion of second mixing chamber 219 draws residual foam in foaming area 256 up through passage 244 into second mixing chamber 219. The one or more air/liquid pumps (not shown) prevent liquid from flowing through liquid inlet 202 and air from flowing into air inlet 216. The residual foam that is sucked up into second mixing chamber 219 breaks down in mixing chamber 219 not in foaming area 256 and, accordingly, does not drip out of outlet 262. Upon the next actuation of the one or more pumps (not shown) the residual foam, or liquid if the residual foam has broken down, mixes with the liquid air mixture flowing through passage 226 into second mixing chamber 219 and is dispensed out of the outlet 262.

Figure 3:
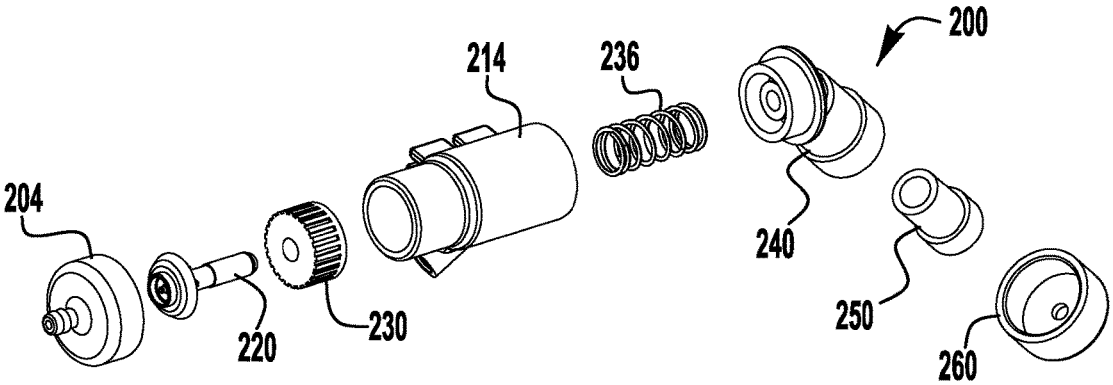
FIG. 3 is an exploded view of the exemplary foam-at-a-distance generator having a suck-back mechanism of FIG. 2.

FIG. 3 is an exploded view of the exemplary foam-at-a-distance generator 200 having a suck-back mechanism 210.

Figure 4:
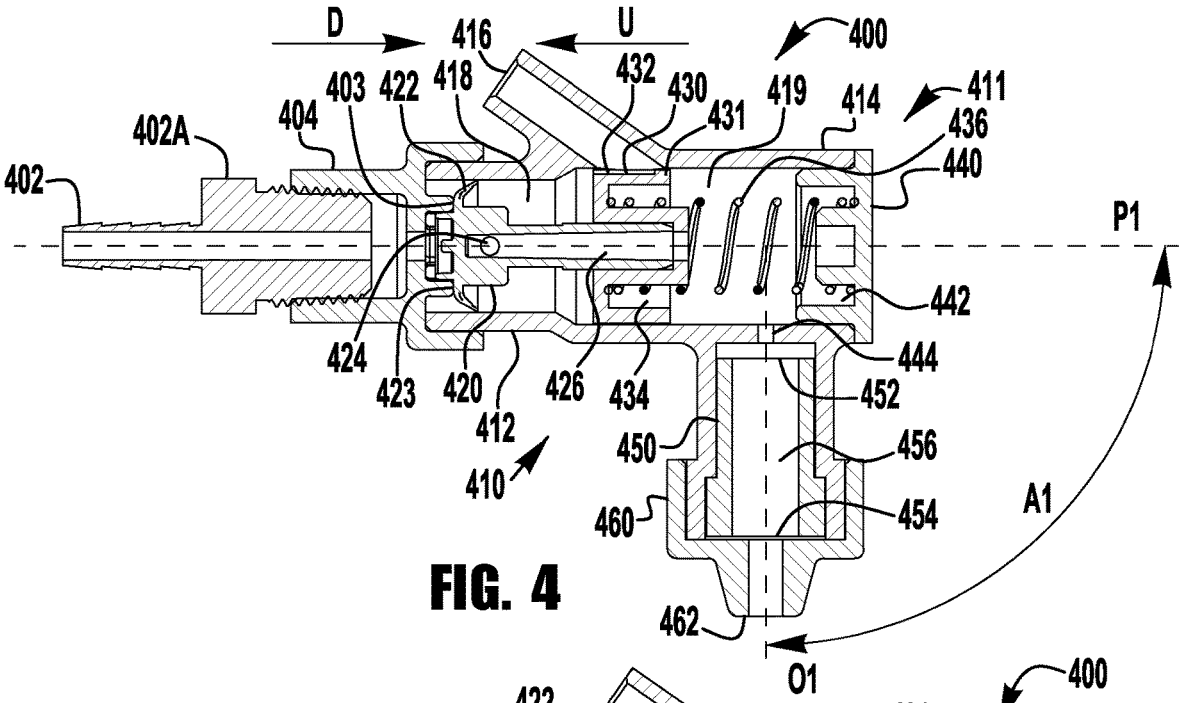
FIG. 4 is a cross-section of an exemplary foam-at-a-distance generator having a suck-back mechanism with the piston in the rest state.

FIG. 4 is a cross-section of another exemplary embodiment of a foam-at-a-distance generator 400 having a suck-back mechanism 410. Suck-back mechanism 410 includes a housing 411 that has a first portion 412 having a small bore and a second portion 414 having a larger bore. Piston 420 includes a wiper seal 422 the contacts interior of the small bore of first portion 412. Attached to the lower end of piston 420 is suck-back sleeve 430. Suck-back sleeve 430 includes a sealing member 431 the contacts the interior bore of second portion 414 of housing 411. In some embodiments, Suck-back sleeve 430 includes serrations 432 that allow air from one or more air pumps (not shown) to flow up into first mixing chamber 418. In some embodiments, suck-back sleeve 430 is an integral part of piston 420. In some embodiments, piston 420 includes first wiper seal 422 and second sealing member 431, which may also be a wiper seal.

Piston 420 includes one or more apertures 424 which lead(s) to the hollow interior 426 of piston 420 and suck-back sleeve 430. Housing 411 includes an air inlet 416 that enters into an upper area of second portion 414 of housing 411. The air inlet 416 enters above seal 431 so that air flowing through air inlet 416 flows up into first mixing chamber 418. In addition, suck-back sleeve 430 includes an annular recess 434 for receiving a first end of biasing member 419. Biasing member 419 may be any member that urges piston 420 and suck-back sleeve 430 in the upstream direction "U", such as, for example, a spring, an elastomeric member, a bellows, or the like.

Connected to second portion 414 of housing 411 of suck back mechanism 410 is end cap 440. End cap 240 includes an annular recess 442 for receiving a second end of biasing member 419.

In fluid communication through pathway 444 with second mixing chamber 419 is foaming housing 448. Foaming housing 448 forms a portion of pathway 44 that is sized to receive foaming cartridge 450. Foaming cartridge 450 includes a first screen 452, a foaming area 456, a second screen 454. Located at the distal end of pathway 444 is an outlet 2462 located in cap 460. In some embodiments, the foam cartridge is replaced by one or more baffles, one or more porous members, such as screens, sponges, foam, and the like.

Connected first portion 412 of housing 411 of suck-back mechanism 410 is cap 404. Cap 404 receives a fitting 402A that includes a liquid inlet 402 for receiving liquid from one or more liquid pumps (not shown). Cap 404 includes an annular seat 403. Piston 420 includes a sealing surface 423 that seals against annular seat 403 when the piston 420 is in its rest position or its fully upstream position as shown in FIG. 4. In this position, piston 420 functions as a liquid inlet valve closing off liquid inlet 402.

A piston axis "P1" extends through the piston along the axis of piston movement. An outlet axis extends through the outlet 462 along the fluid flow. In some embodiments, the angle "A1" between the piston axis P and the outlet axis O1 is between about 0 and 90°. In some embodiments, the angle "A1" between the piston axis P1 and the outlet axis O1 is between about 0 and 30°. In some embodiments, the angle "A1" between the piston axis P1 and the outlet axis O1 is between about 15 and 75°. In some embodiments, the angle "A1" between the piston axis P1 and the outlet axis O1 is between about 20 and 60°.

Figure 4A:
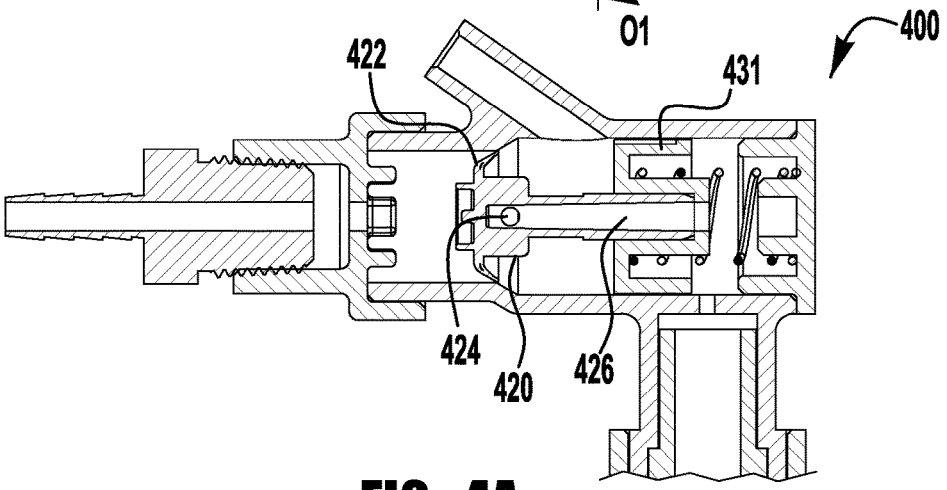
FIG. 4A is a cross-section of the exemplary foam-at-a-distance generator of FIG. 4 having a suck-back mechanism with the piston in the dispensing state.

FIG. 4A is a cross-section of the exemplary foam-at-a-distance generator of FIG. 4 having a suck-back mechanism 410 with the piston 420 and suck-back sleeve 430 in the dispensing state, i.e. the downstream position D.

During operation one or more pumps (not shown) pump liquid into liquid inlet 402 and air into the air inlet 416. In some embodiments, air enters air inlet 416 at the same time as liquid enters liquid inlet 402. In some embodiments, air enters air inlet 416 prior to liquid entering liquid inlet 402. In some embodiments, liquid enters liquid inlet 402 prior to air entering air inlet 416. In some embodiments, the flow of liquid into liquid inlet 402 and air into air inlet 416 stops substantially simultaneously. In some embodiments, the flow of liquid into liquid inlet 402 stops prior to air stopping its flow into inlet 416. In some embodiments, the flow of liquid entering liquid inlet 402 continues after air stops flowing into air inlet 416.

Liquid flowing into liquid inlet 402 moves piston 420 and suck-back sleeve 430 in a downward direction D, or downstream direction, as shown in FIG. 4A. The liquid flows past wiper seal 422 into first mixing chamber 418. Air flows into air inlet 416, past serrations 432 in suck-back sleeve 430, and into first mixing chamber 418. The air and liquid meet in first mixing chamber 418 and flow through aperture 424, through passage 426 and into second mixing chamber 419. The air/liquid mixture flow through into passage 444, through screen 452, into foaming area 456, through screen 454 and out of outlet 462.

When the flow of liquid through liquid inlet 402 stops, biasing member 436 urges piston 420 and suck-back sleeve 430 in the upstream direction U to its rest state shown in FIG. 4. Movement of suck-back sleeve 430 in the upstream direction expands second mixing chamber 419. Expansion a second mixing chamber 419 draws residual foam in foaming area 456 up through passage 444 into second mixing chamber 419. The one or more air/liquid pumps (not shown) prevent liquid from flowing through liquid inlet 402 and air from flowing into air inlet 416. The residual foam that is sucked up into second mixing chamber 419 breaks down in mixing chamber 419 not in foaming area 456 and, accordingly, does not drip out of outlet 462. Upon the next actuation of the one or more pumps (not shown) the residual foam, or liquid if the residual foam has broken down, mixes with the liquid air mixture flowing through passage 426 into second mixing chamber 419 and is dispensed out of the outlet 462.

Figure 5:
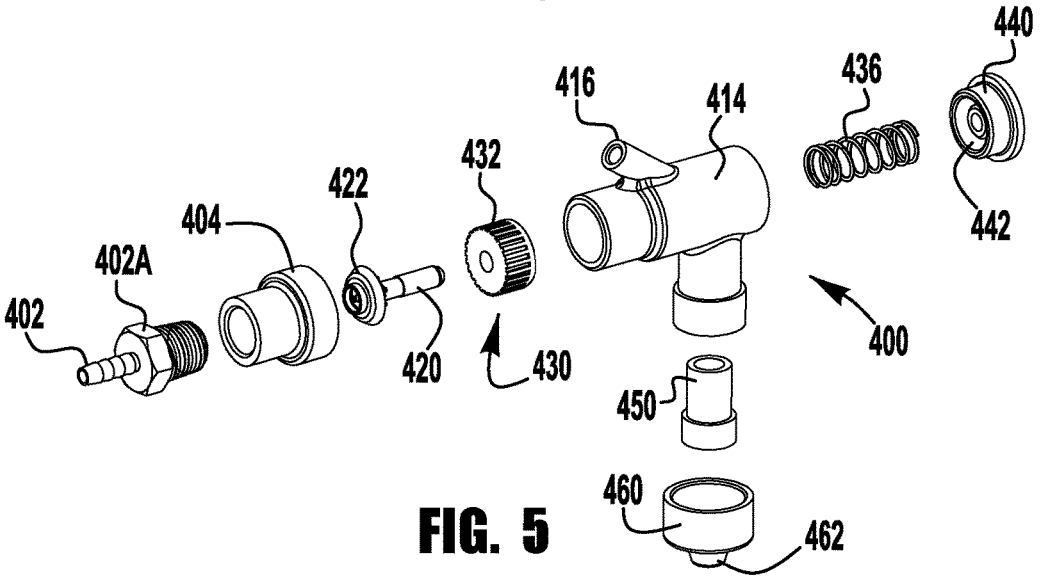
FIG. 5 is an exploded view of the exemplary foam-at-a-distance generator having a suck-back mechanism of FIG. 4.

FIG. 4A is a cross-section of the exemplary foam-at-a-distance generator 400 of FIG. 4 having a suck-back mechanism 410 with the piston 422 in the dispensing state;

FIG. 5 is an exploded view of the exemplary foam-at-a-distance generator 400 having a suck-back mechanism 410 of FIG. 4.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A foam-at-a-distance system comprising:

a dispenser housing configured to be mounted below a counter;

a spout configured to be mounted above a counter a container configured to be mounted below a counter;

a foam generator having a suck-back mechanism located within the spout;

a liquid pump portion;

an air pump portion;

a liquid conduit placing the liquid pump portion in fluid communications with a liquid inlet in the foam generator;

an air conduit placing the air pump portion in fluid communications with an air inlet in the foam generator;

the foam generator having a housing;

the housing having a first portion with a first inside bore and a second portion with a second inside bore, wherein the first inside bore has a smaller diameter than the second inside bore;

a piston having a first seal in contact with the first inside bore;

a second seal extending from the piston and in contact with the second inside bore;

wherein the piston includes a hollow stem;

a first mixing chamber located downstream of the first seal and upstream of the second seal;

a liquid inlet located upstream of the first seal;

an air inlet located downstream of the first seal and upstream of the second seal;

an aperture in the side of a wall into the piston extending into the interior of the hollow stem configured to create a fluid flow path through the piston;

a second mixing chamber located in the large bore;

one or more mix media located downstream of the second mixing chamber; and an outlet;

wherein movement of the second seal in an upstream direction provides negative pressure in the second mixing chamber and draws in fluid from the outlet.

2. The foam-at-a-distance system of claim 1 further comprising a seat member located proximate the liquid inlet and the piston comprises a sealing member for sealing against the seat member.

3. The foam-at-a-distance system of claim 1 wherein the second seal is located on a suck-back sleeve.

4. The foam-at-a-distance system of claim 1 wherein the air inlet in the foam generating housing is located in a wall of the large bore.

5. The foam-at-a-distance system of claim 1 wherein the mix media and the outlet lie along an outlet axis and the piston lies along a piston axis and wherein the outlet axis is offset from the piston axis.

6. The foam-at-a-distance system of claim 5 wherein the outlet axis and piston axis form an angle of between about 0 degrees and 90 degrees.

7. A foam-at-a-distance system comprising:

a spout configured for mounting above a counter a container configured for mounting below a counter;

a foam generator having a suck-back mechanism located within the spout;

a liquid pump portion;

an air pump portion;

a liquid conduit placing the liquid pump portion in fluid communications with a liquid inlet in the foam generator;

an air conduit placing the air pump portion in fluid communications with an air inlet in the foam generator;

the foam generator having a housing;

the housing having a first portion with a first inside bore and a second portion with a second inside bore, wherein the first inside bore has a smaller diameter than the second inside bore;

a piston having a first seal in contact with the first inside bore;

a second seal extending from the piston and in contact with the second inside bore;

a first mixing chamber located downstream of the first seal and upstream of the second seal;

a liquid inlet located upstream of the first seal;

an air inlet located downstream of the first seal and upstream of the second seal;

a second mixing chamber located in the large bore;

wherein movement of the second seal in an upstream direction provides negative pressure in the second mixing chamber and draws in fluid from the outlet.

8. The foam-at-a-distance system of claim 7 further comprising a seat member located proximate the liquid inlet and the piston comprises a sealing member for sealing against the seat member.

9. The foam-at-a-distance system of claim 7 further comprising a biasing member to bias the piston in the upstream direction.

10. The foam-at-a-distance system of claim 7 wherein the second seal is located on a suck-back sleeve.

11. The foam-at-a-distance system of claim 10 further comprising serrations on the suck-back sleeve.

12. The foam-at-a-distance system of claim 7 wherein the air inlet in the foam generating housing is located in a wall of the large bore.

13. The foam-at-a-distance system of claim 7 further comprising a mix media, wherein the mix media and the outlet lie along an outlet axis and the piston lies along a piston axis and wherein the outlet axis is offset from the piston axis.

14. The foam-at-a-distance system of claim 13 wherein the outlet axis and piston axis form an angle of between about 0 degrees and 90 degrees.

15. A foam-at-a-distance system comprising:

a spout configured for mounting above a counter a container configured for mounting below a counter;

a foam generator located within the spout;

a liquid pump chamber;

an air pump chamber;

a liquid conduit placing the liquid pump chamber in fluid communications with a liquid inlet in the foam generator;

an air conduit placing the air pump chamber in fluid communications with an air inlet in the foam generator;

a piston;

the piston moving between a first position and a second position;

wherein liquid flowing in through the liquid inlet moves the piston in a first direction;

wherein a biasing member moves the piston in a second direction that is substantially opposite the first direction;

a first piston seal, wherein the first piston seal allows liquid to flow past the first piston seal;

wherein the liquid inlet is located upstream of the first piston seal;

wherein the air inlet is located downstream of the first piston seal;

a second piston seal located downstream of the air inlet;

a mixing chamber;

wherein movement of the second piston seal in a downstream direction decreases the mixing chamber volume and movement of the second piston seal in an upstream direction increases the volume of the mixing chamber and draws in fluid from the outlet.

16. The foam-at-a-distance system of claim 15 further comprising a seat member located proximate the liquid inlet and a piston having a liquid inlet wiper seal and a sealing member for sealing against the seat member.

17. The foam-at-a-distance system of claim 15 further comprising a first sealing member and a second sealing member, wherein the first sealing member reciprocates in a first diameter bore and the second sealing member reciprocates in a second diameter bore and wherein the second diameter is greater than the first diameter.

18. The foam-at-a-distance system of claim 15 wherein the second sealing member is located on a suck-back sleeve.

19. The foam-at-a-distance system of claim 18 further comprising serrations on the suck-back sleeve.

20. The foam-at-a-distance system of claim 15 further comprising a mix media and an outlet, wherein the mix media and the outlet lie along an outlet axis and the piston lies along a piston axis and wherein the outlet axis is offset from the piston axis.

* * * * *